US007370765B1

(12) United States Patent
Ellenberger et al.

(10) Patent No.: US 7,370,765 B1
(45) Date of Patent: May 13, 2008

(54) APPARATUS FOR SORTING LAUNDRY PIECES

(75) Inventors: Karl-Heinz Ellenberger, Wüstenrot-Neuhütten (DE); Helmut Erb, Heilbronn (DE)

(73) Assignee: Lavatec A.G., Heilbronn (DE)

( * ) Notice: Subject to any disclaimer, the term of this patent is extended or adjusted under 35 U.S.C. 154(b) by 0 days.

(21) Appl. No.: 09/595,136

(22) Filed: Jun. 16, 2000

(30) Foreign Application Priority Data

Dec. 22, 1999 (DE) ..... 299 22 555 U

(51) Int. Cl.
*B07C 5/00* (2006.01)

(52) U.S. Cl. ..... 209/644; 209/587; 209/912; 209/937

(58) Field of Classification Search ..... 209/577, 209/587, 583, 644, 917, 932, 937, 912
See application file for complete search history.

(56) References Cited

U.S. PATENT DOCUMENTS 1,597,527 A * 8/1926 Lane ..... 209/703
3,373,869 A * 3/1968 Burson ..... 209/3.1
3,753,484 A * 8/1973 Aiuola et al. ..... 198/20
4,036,365 A * 7/1977 Rosenfeld ..... 209/3.1
4,136,778 A * 1/1979 Wortman et al. ..... 209/589
4,239,435 A * 12/1980 Weiss et al. ..... 414/136
5,301,809 A * 4/1994 Skinner ..... 209/3.1
5,377,814 A * 1/1995 Smith et al. ..... 198/465.4
5,700,293 A * 12/1997 Rydell ..... 8/137
2001/0032805 A1 * 10/2001 Lawandy et al. ..... 209/3.3

* cited by examiner

*Primary Examiner*—Joseph C. Rodriguez
(74) *Attorney, Agent, or Firm*—Darby & Darby P.C.

(57) ABSTRACT

A device for sorting of laundry pieces comprises a transport device for transporting different types of laundry pieces, a first collection device for receiving a first type of laundry pieces and disposed in a receiving relationship to the transport device, a second collection device for receiving a second type of laundry pieces and disposed in a receiving relationship to the transport device, and a recognition device disposed near the transport device such that laundry pieces disposed on the transport device are recognizable for the recognition device. A register device is predisposed to the first collection device and to the second collection device for registering of the laundry pieces disposed in the transport device and for generating a corresponding register signal. A data processing plant is connected to the recognition device and to the registering device and for receiving and then processing the data signals received from the recognition device and for receiving and then processing the register signal received from the register device.

28 Claims, 2 Drawing Sheets

APPARATUS FOR SORTING LAUNDRY PIECES

BACKGROUND OF THE INVENTION

1. Field of the Invention

The present invention relates to an apparatus for sorting of laundry pieces. Such sorting for example is then required when different laundry pieces have to be washed according to different washing programs.

2. Brief Description of the Background of the Invention Including Prior Art

It is known to sort laundry pieces manually. Depending on the respective criteria of sorting, the concerned laundry pieces are individually thrown into a corresponding plurality of laundry containers. This sorting method can be slightly enhanced by predisposing a suction tube to the individual collection containers. The operator then only has to throw the laundry in the region of the suction opening of that tube, which leads to in each case desired collection container. The throw speed and the hit accuracy can be increased thereby.

It is further known to throw laundry pieces through a frame. Such a frame however is less suitable for sorting and more suitable for counting of the individual laundry pieces, which are to be washed.

SUMMARY OF THE INVENTION

1. Purposes of the Invention

It is an object of the present invention to furnish an improved possibility of a sorting of laundry pieces.

These and other objects and advantages of the present invention will become evident from the description which follows.

2. Brief Description of the Invention

The present invention employs a recognition device known in principle in the state-of-the-art. In connection with such recognizing devices, the items to be identified in each case are furnished with a coding prior to washing. The coding can be read, that means the coding can be recognized. The recognition signal is compared in a data processing plant with a stored reference signal, such that different objects depending on the code applied in each case to the object can be automatically recognized.

The code is applied to the laundry prior to sorting according to the sorting device of the present invention. As a rule this is performed by furnishing laundry pieces for example with a thread containing a coding, a thread piece or other textile or nontextile band. Then the coding present on the thread, the thread piece, or the other coding carrier present at the laundry piece is read by the recognition device and the read recognition signal is compared with a stored reference value. Depending on in each case recognized special laundry piece, this special laundry piece is then fed to a predetermined collection device. The laundry pieces to be washed are here individually fed to the recognition device, individualized recognized by the recognition device and then a respective laundry piece is fed to the collection device coordinated to the laundry piece.

The transport device for transfer of laundry pieces from the recognition device to the collection device can advantageously be furnished with a transport band. The collection device can then be disposed easily surveyable in transport direction along the transport belt. The individual collection devices allow also to be moved away without problem, brought in position or, respectively exchanged from their so to speak aligned positions next to the transport band.

A blow method has proved to be particularly advantageous for the collection or, respectively, transfer of the laundry pieces from the transport device as for example the transport band into the individual containers. The said individual laundry pieces resting on the transport belt can be blown off the transport belt by correspondingly disposed blowing nozzles such that the laundry pieces fall into the collection containers disposed next to the band.

The recognition device delivers its recognition signals to the data processing plant. The data processing plant is connected to the complete control and drive technology, such that the data processing can take into consideration the speed with which the laundry pieces are transported within the transport device for example on the transport band. The data processing plant can therefore know when the laundry piece recognized by the recognition device has arrived at in each case predetermined collection device. For example, in each case responsible blowing nozzles can be activated by the data processing plant.

While this controlling of the blowing nozzles and thereby blowing off of the laundry piece of the transport belt for example into the collection container in each case coordinated to this laundry piece is controlled through the speed of the transport belt, the controlling of the blowing nozzles can also be performed by registering devices for example predisposed to the blowing nozzles. The registry devices can be for example light barriers, which registered the arrival of the laundry piece and then deliver a corresponding registration signal to the data processing plant. If the register device is disposed in front of the blowing device, the blow device can be controlled immediately or, respectively with a preceding delay through this register device and then through the data processing plant. If such a registering device is disposed in front of a group of blower devices and thereby in front of a group of collection containers, then the in each case proper blower nozzles can be switched on and thereby activated not in dependence of the registering signal but under consideration of the transport speed.

Possibly a register device is disposed in front of and behind of a blow device. While in the predisposed register device determines the arrival of a laundry piece and then, when it is the right laundry piece, activates the coordinated blower nozzles, also a register device disposed after leaving the blower nozzles can make sense. It can be determined with a postdisposed registering device, if the laundry piece also in fact, if desired and controlled, was blown off by the blower nozzles.

By employing a sensor device furnished as a light barrier, which runs cross from one side to the other side of the transport belt and thereby also reaches perpendicular through the blower corridor, it can be achieved that the respective light barrier is present simultaneously both in front of as well as behind the blow device. In this manner, the light barrier cannot only signalize the arrival of a laundry piece but beyond that also signalize, if the laundry piece after leaving of the blower corridor still is present on the transport band.

According to an embodiment illustrated also in the drawing, laundry pieces are not fed immediately to the recognition device, but through a predisposed feed device, wherein the feed device is formed as a transport band. An arbitrary large number of feed devices can be disposed above the transport band, wherein the laundry pieces are thrown in individually into which feed devices in each case and the individual laundry pieces are transferred such to the feed device that the laundry pieces exhibit a mutual distance in transport direction, which mutual distance does not fall below a minimum value. The minimum value depends on the processing speed of the recognition device.

The feeding device formed as funnels is associated with the advantage that the laundry pieces falling from the funnel downward do not surpass a pre-given light space profile. The laundry pieces therefore are not disposed on too large an area on the belt. The larger in fact the laundry pieces are present on the belt, the larger the recognition device has to be formed constructively and the more a large area will be required to be worked by the recognition device.

In order to achieve that the laundry pieces can be safely recognized in the recognition direction it has to be assured that the laundry pieces having a mutual distance, which does not fall below a certain predetermined minimum value, and/or having a time interval, which does not fall below a certain predetermined minimum value, are transferred to this recognition device. This can be accomplished by suitable control devices for emptying the funnel. It can be for example provided that flap floors of the funnels present are only jointly controlled and thereby only jointly opened.

It is furthermore possible to throw the laundry pieces not immediately into the funnels but to predispose a feed band to the funnels. This feed band can exhibit individual compartments, wherein the operating persons lay individual laundry pieces into the individual compartments. In this manner, the individual putting away of laundry pieces, which is performed by hand, can be realized in a simple way and free from interferences and at the same time a uniform feeding of the individual funnels is accomplished.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1:
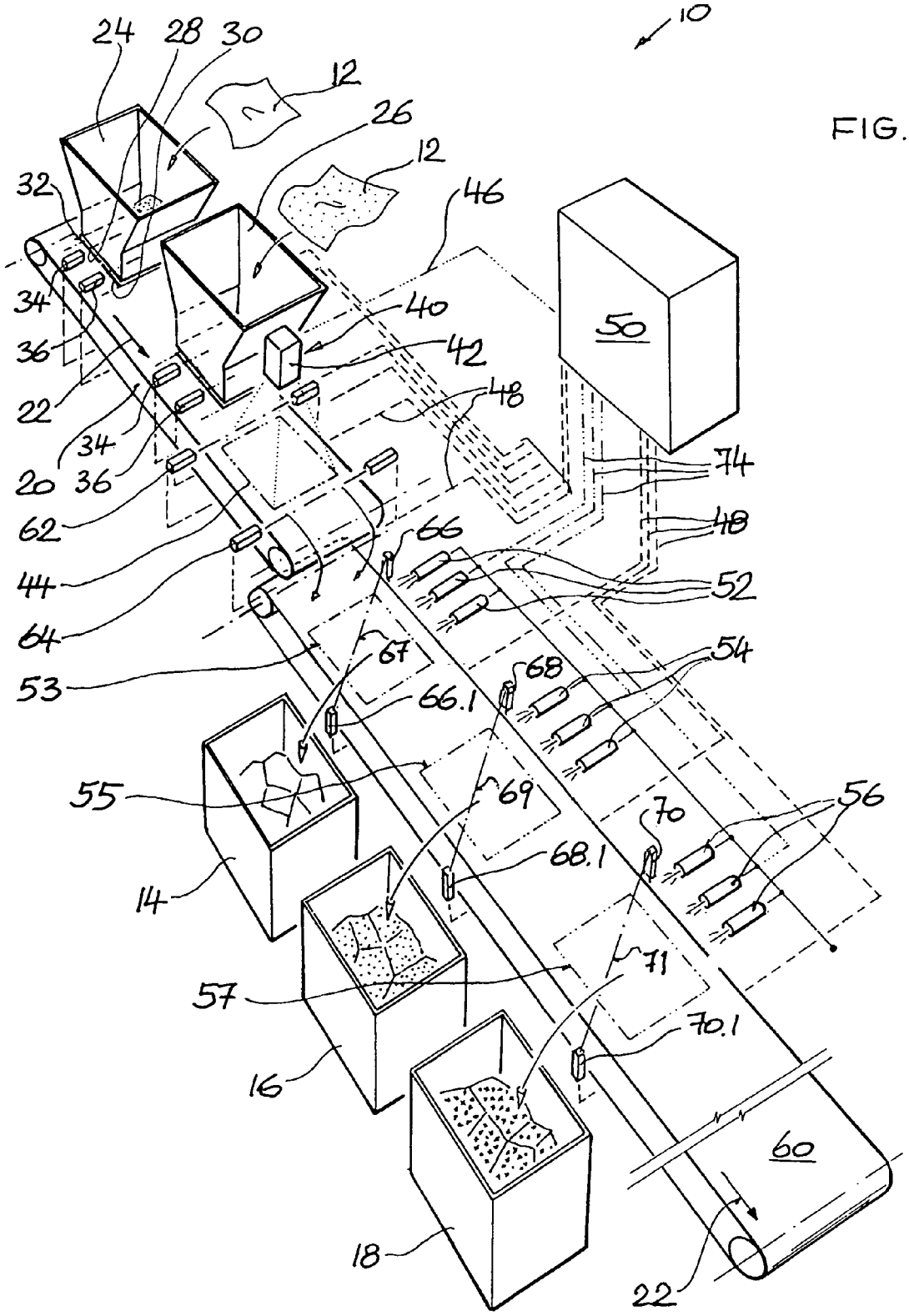
FIG. 1 is a perspective schematic view of a sorting device according to the invention.
Figure 2:
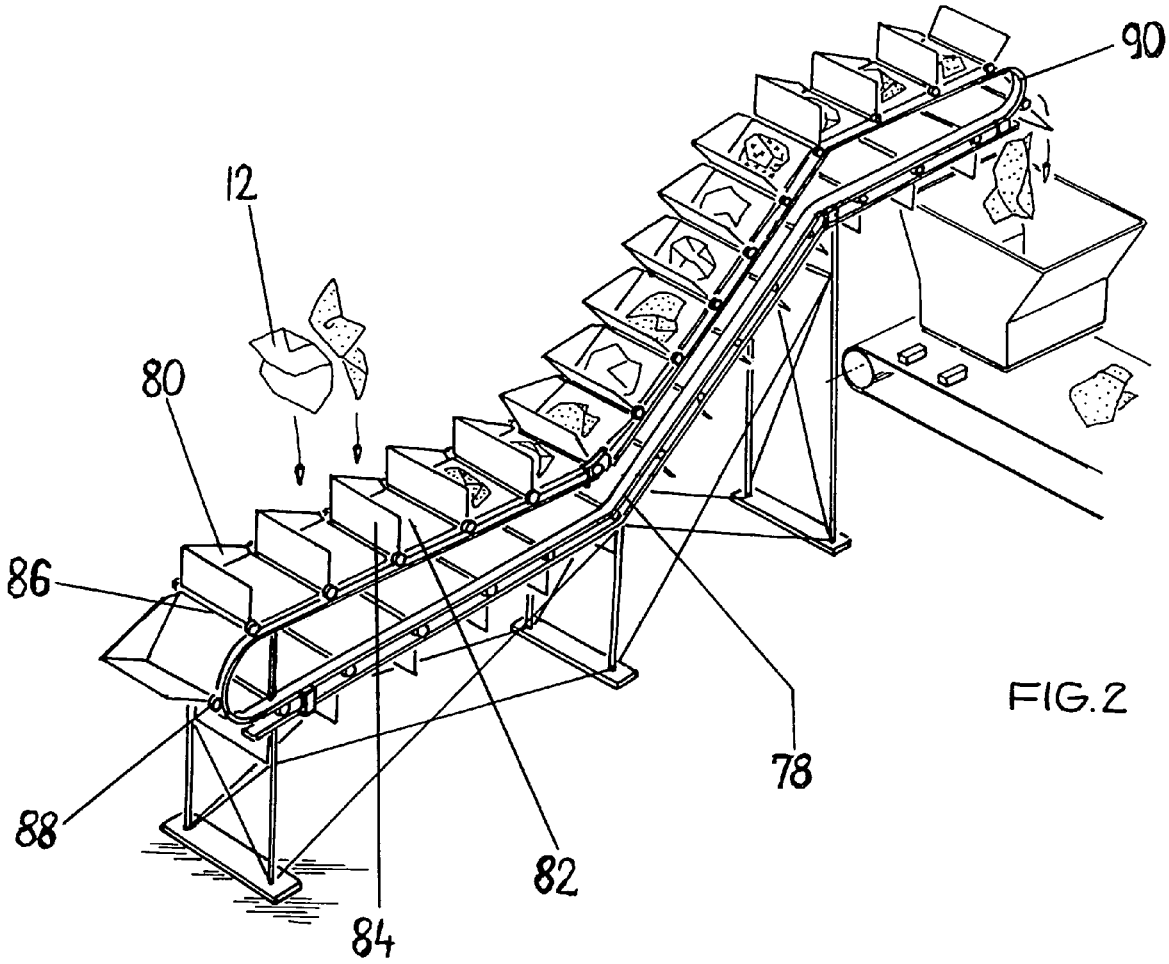
FIG. 2 is a perspective view of a transport band for loading the laundry pieces onto the sorting device according to the invention.

In accordance with the present invention, the device 10 illustrated in FIG. 1 for sorting of laundry pieces 12 into individual and different collection containers 14, 16, 18 is furnished with an endless circulating transport band 20. The circulation speed of the endless circulating transport band 20 in the present example is of a constant value.

Two funnels 24, 26 are disposed above the endless circulating transport band 20 in transport direction 22. The laundry pieces 12 are thrown individually and successively into the funnels 24, 26 by for example two operators. Alternatively, the laundry pieces can be delivered by a first transport band 78. The first transport band is disposed at about an angle of 90 degrees relative to the endless circulating transport band 20. The first transport band is furnished with compartments, which aid in the individualization of laundry pieces and which provide a substantially uniform special distance and point in dropping time distance for the laundry pieces delivered to the endless circulating transport band 20. The compartments 80 have a floor 82 and a rear wall 84 suitable for a horizontal and upward transporting motion. The compartments 80 can be chained by hinge connections 86. The hinge connections can be furnished with a wheel 88 on each end, wherein the wheels 88 are supported by and run on a respective endless support track 90.

The operator generally will through laundry pieces into the compartments 80 of the first transport band 78. Preferably only a single piece of laundry is deposited in an individual compartment 80. If each compartment 80 of the first transport band 78 is filled with a single piece of laundry, an optimum capacity use is accomplished for the first transport band 78 and a maximum number of laundry pieces can be sorted. The speed of the first transport band is adapted to the operational speed of the recognition device 40 and thereby also adapted to the opening speed of the receptacles, that is of the funnels (24, 26). Naturally, a separate transport band of the type of the first transport band 78 would be provided for each one of the two funnels 24, 26.

Each of the funnels 24, 26 is furnished at the bottom with a flap floor 32 comprising two flap parts 28, 30. Two sensors 34, 36 act into the region above the flap floor 32 and thereby above the two flap parts 28, 30, wherein the two sensors 34, 36 comprise two light barriers in the present embodiment. The laundry piece 12 resting on the flap floor 32 is recognized by the two sensors to 34, 36 and thereupon the flap floor 32 is opened. During this opening, the two flap parts 28, 30 flap open downwardly such that the laundry piece 12 can fall downwardly onto the transport band 20.

The flap floors 32 can be opened only simultaneously by the two funnels 24, 26 according to the present embodiment. This accomplishes that the laundry pieces 12 put down onto the transport band 20 from the two funnels 24, 26 exhibit a mutual distance in transport direction 22, wherein the mutual distance corresponds to the distance of the two funnels 24, 26 of this transport direction 22.

The laundry pieces 12 put down on the transport band 20 migrate in transport direction 22 into the region of a recognition device 40, wherein the recognition device 40 monitors a region 44 by way of a laser 42 and recognizes individualizing a laundry piece 12 present in the region 44.

For example laundry pieces may have to be individualized and sorted, which laundry pieces have extremely different sizes. These laundry pieces have to arrive individualized at the region 44 for allowing recognition by the recognition device 40. The individualization is monitored, tested and assured by the sensors 62 and 64 disposed neighboring to the region 44.

Codings are applied at the laundry pieces 12, wherein the codings allow for the laser 42 to recognize the respective laundry piece. For example it is recognized in this way, if the laundry piece is a napkin, a hand towel or a bed sheet. In each case a different coding would be present with these three laundry pieces according to the present example. The coding could contain additionally other features such as for example an identification of the respective customer or other information.

A data signal 46 is sent from the recognition device 40 to a data processing plant 50 connected to the apparatus control of the device 10, wherein the data signal 46 corresponds the read out coding. This data signal 46 is processed in the data processing plant and as a consequence thereof the laundry piece scanned in the region 44 by the laser 42 is recognized as a napkin or as a hand towel or as a bed sheet.

It is programmed into the data processing plant 50 that for example napkins are to be sorted into the collection container 14, hand towels in the collection container 16, and bed sheets into the collection container 18. Blow nozzles 52, 54; 56 are activated by the data processing plant 50 through corresponding control signals in each case, if the respective laundry piece 12 has arrived in the region 53, 55 or 57 in front of the blow nozzles 52, 54, 56. The transport is performed by way of a transport band 60. The laundry pieces 12 leaving the recognition device 40 fall onto this transport band 60 in the case of the present example.

Sensors 62, 64 are disposed in front of and behind the recognition device 40. The sensors 62, 64, in turn generating again light barriers, recognize on the one hand if a laundry piece 12 moves into the region of the recognition device 40 (sensor 62) and on the other hand (sensor 64), if the laundry piece 12 has also again left the recognition device 40. For example, the recognition device 40 is started only then, when a laundry piece 12 has moved into the region of the sensor 62. For example, the further transport of this recognized and by the data processing plant 50 registered laundry piece 12 can be controlled by the post disposed and switched sensor 64. Two different laundry pieces 12 are not permitted to be simultaneously present in the region of the recognition device 40. Depending on the present transport speed of the transport band 20, 60 it can then be determined at what time the laundry piece 12 present in the region of the sensor 64 will be disposed in front of the blow nozzles 52, 54, or 56. The sensor 62 and/or 64 deliver a register signal 48 to the data processing plant 50, wherein the register signal 48 contains the presence of a laundry piece 12.

The sensors 62, 64 examine in particular, if a laundry piece is present and if the respective laundry piece, if it is located in the region 44, is not registered by the sensors 62, 64 simultaneously as present. Advantageously, it would be possible to recognize by a time/distance circuit, when a laundry piece leaving the recognition device 40 and/or the region 44, which is recognized by the sensor 64, was transported by the endless circulating transport band 20 and was then transported by the transport band 60 into the region 53, or respectively 55, or respectively 57, from where it was blown into an associated collection container 14, 16, 18. The blow nozzles 52, 54, or, respectively, 56 can also be controlled through a time/distance circuit.

The blow nozzles 52, 54,56 can also be activated correspondingly by sensors 66, 68 and 70. The sensors 66, 68,70 are associated with respective counter sensors on the one hand on the other side transport band 60 and on the other hand diagonally opposite, such that the counter sensors 66.1 or, respectively, 68.1 and 70.1 cover on the one hand the transport band 60 and on the other hand cover the region of the blow nozzles 52, 54 and, respectively, 56. It can therefore be recognized by the corresponding light barriers 67, 69, or 71, when a laundry piece 12 moves into the region 53, 55 or 57 and then the corresponding blow nozzles 52, 54, 56 are activated as long as in each case the right laundry piece is disposed at the proper collection container 14, 16, 18. In addition it can also be recognized by this light barrier 67, 69, 71, if a laundry piece still remained on the transport band 60 after a switching off of the blow nozzles 52, 54, 56. In case the blow nozzles have been activated, then the laundry piece is not permitted to be disposed any longer in the region of the corresponding light barrier.

The control of the blow nozzles 52, 54, 56 is controlled by the data processing plant 50 through control signals 74. The signals come together in the data processing plant 50, wherein the signals are emitted by the individual sensors 32, 36, 62, 64, 66, 68, 70. In addition the data processing plant 50 receives the data signals 46 emitted by the recognition device 40, wherein the data signals 46 enable an identification of the laundry piece in each case to the effect into which collection container 14, 16, 18 the respective laundry piece 12 is to be blown by the blow nozzles 52 or 54 or 56.

Instead of the two funnels 24, 26 there can also be several such funnels be arranged. Instead of the three collection containers 14, 16, 18 there can also still more collection containers be disposed along one or several transport bands 60.

It will be understood that each of the elements described above, or two or more together, may also find a useful application in other types of transport system configurations and piece processing procedures differing from the types described above.

While the invention has been illustrated and described as embodied in the context of a device for sorting of laundry pieces, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

The invention claimed is:

1. A device for sorting laundry pieces comprising:

a feed device that receives the laundry pieces and dispenses them;

a transport device that receives the laundry pieces dispensed from the feed device at a predetermined interval, wherein the interval is one of a predetermined distance between the laundry pieces on the transport device and a predetermined period of time between the dispensing of the laundry pieces, so that individual laundry pieces are separated from each other, wherein the transport device comprises a conveyor belt that transports the individual, separated laundry pieces in a transport direction;

a recognition device disposed in relation to the transport device for determining different types of the separated laundry pieces being transported by the transport device through a region, the recognition device generating a data signal in response to the recognition of one of the individual, separated laundry pieces;

a registering device disposed in relation to the transport device for sensing a location of the one laundry piece on the transport device, the registering device generating a register signal indicating that the one laundry piece is present at the location;

a data processor for receiving the data signal and the register signal for the, the data processor associating the data signal and the register signal, and generating a control signal in response thereto;

a plurality of collection containers disposed downstream of the recognition device in the transport direction at different locations for receiving laundry pieces, wherein the individual collection containers are predetermined to receive particular types of laundry pieces; and a collection device for directing a particular type of laundry pieces to one of the predetermined collection containers, based on the control signal from the data processor, wherein the feed device further comprises a first transport band having a plurality of individual compartments for receiving individual laundry pieces, and the individual laundry pieces of the first transport band are emptied onto the transport device leading to the recognition device.

2. The device according to claim 1, wherein the collection containers are disposed along the conveyor belt in a transport direction.

3. The device according to claim 1, wherein the collection device further comprises a plurality of blower devices coordinated to the collection containers, wherein when the collection device receives the control signal from the data processor, the control signal directs a corresponding blower device to generate a stream of air and the stream of air is directed horizontally and perpendicularly to the direction of the transport device in the region of the laundry pieces, and when an individual laundry piece has been conveyed separately and disposed in a collection device area corresponding to the blower device, the individual laundry piece is thereby blown into one of the plurality of collection containers, and wherein when the laundry piece is not blown into the one collection container, the control signal delivered by the data processor is re-generated and the corresponding blower device generates a further stream of air.

4. The device according to claim 3, wherein the registering device further comprises a plurality of paired counter sensors, each sensor pair generating a light barrier for recognizing movement of one of the plurality of laundry pieces to one of the plurality of locations and being fixedly disposed with respect to one of the blower devices, such that one sensor in the sensor pair is positioned upstream of the blower device on a blower device side of the conveyor belt while the other sensor is positioned downstream from the blower device on a collection side of the conveyor belt, the sensor pair thereby generating a light barrier that is diagonally oriented with respect to the stream of air generated by the one blower device.

5. The device according to the claim 1, wherein individual collection containers are furnished with the registering device.

6. The device according to claim 5, wherein the registering device is predisposed and preswitched to the collection containers.

7. The device according to claim 5, wherein the registering device is disposed behind the collection containers.

8. The device according to claim 5, wherein the registering device is pre disposed and post disposed to the collection containers.

9. The device according to claim 1, wherein the transport device transports the laundry pieces to the recognition device.

10. The device according to claim 1, wherein the feed device further comprises a funnel, and wherein the individual laundry pieces disposed within the funnel are emptied onto the transport device leading to the recognition device.

11. The device according to claim 10, wherein the funnel is furnished with a flap floor, wherein the flap floor is opened and closed such that the laundry pieces-falling out of the funnel are transferred to the recognition device by the transport device at the predetermined interval.

12. The device according to claim 11, wherein the flap floor further comprises a plurality of flap parts.

13. The device according to claim 12, further comprising a sensor device present at each flap part for recognizing a predetermined volume of laundry pieces on the flap parts.

14. The device according to claim 11, wherein there are a plurality of funnels and the flap floors are opened only jointly and are closed only jointly.

15. The device according to claim 10, further comprising a sensor device for recognizing one of a predetermined number and a predetermined volume of laundry pieces present within the funnel.

16. The device according to claim 1, wherein the recognition device comprises a laser scanner.

17. A device for sorting of laundry pieces comprising:

a feed device that receives the laundry pieces and dispenses them;

a transport device for transporting different types of laundry pieces dispensed from the feed device at a predetermined interval, wherein the interval is one of a predetermined distance between the laundry pieces on the transport device and a predetermined period of time between the dispensing of the laundry pieces, so that individual laundry pieces are separated from each other, and wherein the transport device comprises a conveyor belt that transports the individual, separated laundry pieces in a transport direction;

a first collection device for receiving a first type of laundry piece, the first collection device being disposed in a receiving relationship to the transport device;

a second collection device for receiving a second type of laundry piece, the second collection device being disposed in a receiving relationship to the transport device;

a recognition device disposed near the transport device for determining different types of laundry pieces dispensed on the transport device, and for generating a data signal related thereto, the transport device transferring a laundry piece according to the data signal, the transport device transferring the laundry piece to a region near the first collection device if the data signal indicates that laundry piece is of a first laundry type, and transferring the laundry piece to a region near the second collection device if the data signal indicates that the laundry piece is of a second type;

a registering device located with respect to the first collection device and to the second collection device for registering the transferred laundry piece and generating a corresponding register signal;

a data processor connected to the recognition device and to the registering device for receiving and processing the data signal received from the recognition device, and for receiving and processing the register signal received from the registering device, and generating a control signal in response thereto; and a controller connected to the data processor for receiving the control signal, the controller selecting one of the first collection device and the second collection device based on the control signal and operating the selected collection device to receive the transferred laundry piece, wherein the feed device further comprises a first transport band having a plurality of individual compartments for receiving individual laundry pieces, and the individual laundry pieces of the first transport band are emptied onto the transport device leading to the recognition device.

18. The device according to claim 17, wherein the first collection device and the second collection device are disposed along the conveyor belt in the transport direction; and wherein the controller further comprises:

a first blower device coordinated to the first collection device for generating a first stream of air in response to the control signal, wherein the first stream of air is directed against the laundry piece on the conveyor belt when the laundry piece is of the first type;

a second blower device coordinated to the second collection device for generating a second stream of air in response to the control signal, wherein the second stream of air is directed against the laundry piece on the conveyor belt when the laundry piece is of the second type; and whereby the laundry piece is blown into its respective collection device.

19. The device according to claim 18, wherein the registering device comprises:

a first registering device predisposed and associated with respect to the first collection device, and a second registering device predisposed and associated with respect to the second collection device.

20. The device according to claim 18, wherein the registering device comprises:

a first registering device disposed following the first collection device, and a second registering device disposed following the second collection device.

21. The device according to claim 17, wherein the feed device comprises:

a feed transport band having a plurality of individual compartments, wherein individual laundry pieces are received into the individual compartments of the feed transport band;

a funnel for receiving the individual laundry pieces from the individual compartments of the feed transport band, the contents of the funnel are emptied onto the transport device leading to the recognition device;

wherein the funnel is furnished with a flap floor which may be flapped open and flapped closed such that laundry pieces falling out of the funnel are transferred on the transport device to the recognition device at the predetermined interval, and wherein the flap floor is formed from a plurality of flap parts.

22. The device according to claim 21, further comprising:

a second funnel;

a second flap floor associated with the second funnel, wherein the second flap floor of the second funnel is only jointly flapped open or and only jointly flapped closed together with the first flap floor of the first funnel;

a first sensor device recognizing one of a predetermined number and volume of laundry pieces present within the first funnel; and a second sensor device recognizing one of a predetermined number and a predetermined volume of laundry pieces present within the second funnel.

23. A method for sorting of laundry pieces comprising the steps of:

receiving the laundry pieces in a feed device comprising first transport band having a plurality of individual compartments for receiving individual laundry pieces;

dispensing the individual laundry pieces from the feed device to a transport device at a predetermined interval, wherein the interval is one of a predetermined distance between the laundry pieces on the transport device and a predetermined period of time between the dispensing of the laundry pieces, so that individual laundry pieces are separated from each other, and wherein the transport device comprises a conveyor belt that transports the individual, separated laundry pieces in a transport direction;

operating the conveyor belt to receive the laundry pieces dispensed from the feed device to the on a transport device in order to transport the individual, separated laundry pieces to positions on and along the conveyor belt that are within reach of a recognition device and in a delivery relationship to a plurality of collection devices;

recognizing different types of laundry pieces with the recognition device;

delivering a data signal corresponding to one of the individual, separated laundry pieces from the recognition device to a data processor;

processing the data signal received from the recognition device in the data processor;

registering the one laundry piece with a register device predisposed relative to the plurality of collection devices;

generating a corresponding register signal associated with the registration of the one individual laundry piece in the register device;

sending the register signal from the register device to the data processor;

generating a corresponding control signal for the one laundry piece in response to the received data signal and the received register signal;

using the data processor to select one of a plurality of the collection devices depending on the data signal;

employing the control signal for controlling the one collection device for receiving the one laundry piece corresponding to the control signal;

transferring the one laundry piece from the recognition device to the one collection device; and receiving the one laundry piece in the one collection device.

24. The method according to claim 23, further comprising the steps of:

disposing the plurality of collection devices along the conveyor belt in a transport direction;

coordinating a blower device to the one collection device;

connecting the blower device to the data processor for controlling the blower device;

furnishing the plurality of collection devices with a register device;

delivering a control signal from the data processor for directing the blower device to generate a stream of air;

directing the stream of air horizontally and perpendicularly to the direction of the transport device in a region of the one laundry piece that is disposed in a collection device area corresponding to the blower device; and blowing the one laundry piece into a container of the one collection device.

25. The method according to claim 23, further comprising the steps of:

predisposing the registering device relative to the one collection device.

26. The method according to claim 23, further comprising the steps of:

post disposing the register device behind the one collection device.

27. The method according to claim 23, further comprising the steps of:

furnishing a feed transport band having at least individual compartments as part of the feed device, each individual compartment being arranged to transport one of the individual, separated laundry pieces;

furnishing at least one funnel with a flap floor for receiving laundry pieces from the compartments of the feed transport band;

emptying a contents of the funnel onto the conveyor belt of said transport device leading to the recognition device; and flipping open and flipping closed the flap floor such that laundry pieces falling out of the funnel are transferred by the transport device to the recognition device.

28. The method according to claim 23, further comprising the steps of:

employing and disposing a plurality of funnels further comprising a plurality of flap floors, wherein the flap floors are flipped open only jointly and are flipped closed only jointly;

furnishing a sensor device for recognizing one of a predetermined number of laundry pieces and a predetermined volume of laundry pieces within each funnel; and disposing the sensor device at each flap part for recognizing one of a predetermined number and a predetermined volume of laundry pieces on each flap part.

* * * * *